United States Patent [19]

Ridley

[11] 4,019,906

[45] Apr. 26, 1977

[54] CURTAIN COATING METHOD

[75] Inventor: Kenneth Arthur Ridley, Ilford, England

[73] Assignee: Ciba-Geigy AG, Basel, Switzerland

[22] Filed: Oct. 11, 1974

[21] Appl. No.: 514,255

[30] Foreign Application Priority Data

Oct. 12, 1973 United Kingdom ..... 47671/73

[52] U.S. Cl. ..... 96/68; 118/325; 118/DIG. 4; 427/420

[51] Int. Cl.[2] ..... B05D 1/30; G03C 3/00

[58] Field of Search ..... 427/420; 118/DIG. 4, 118/325; 96/68

[56] References Cited

UNITED STATES PATENTS

| | | | |
|---|---|---|---|
| 1,859,652 | 5/1932 | Bullerjahn | 427/420 X |
| 3,365,325 | 1/1968 | Fraenkel et al. | 427/420 |
| 3,632,374 | 1/1972 | Greiller | 427/420 X |

*Primary Examiner*—Ronald H. Smith
*Assistant Examiner*—Stuart D. Frenkel
*Attorney, Agent, or Firm*—Wenderoth, Lind & Ponack

[57] ABSTRACT

A method of coating a travelling web with at least one layer of a liquid coating composition, includes the steps of moving the web along a path through a coating zone and forming at the coating zone a free-falling vertical curtain which extends transversely of the path and impinges the travelling web to deposit thereon a coating. The free-falling curtain is composed of at least two separately formed free-falling partial curtains which are joined edge to edge, one partial curtain constituting an edge region of the integral curtain and the other or others constituting a central region and another edge region of the integral curtain.

3 Claims, 8 Drawing Figures

CURTAIN COATING METHOD

BACKGROUND OF THE INVENTION

This invention relates to a method of coating travelling web material by the curtain coating method.

In coating apparatus of the curtain coating type a travelling web is coated by causing a free-falling vertical curtain of coating liquid to impinge on to the travelling web to form a layer thereon. An apparatus of this type is described in British patent specification No. 1,276,144. In this specification a single layer of coating liquid is formed on the travelling web. However, in British patent specification No. 1,276,481 a similar apparatus is described wherein a plurality of layers of coating liquid are formed simultaneously on the travelling web.

In curtain coating methods the width of the falling curtain is maintained by the provision of edge guides which define the boundaries of the curtain. The presence of these guides, however, causes non-uniformities of the coating when the whole of the curtain is applied to the moving web. By making the curtain wider than the web to be coated by an amount at least equal to this non-uniform region at each edge, the coating applied to the object or web becomes substantially uniform. When coating a single layer on a travelling web the liquid at the ends of the curtain which overflows at the edges of the travelling web may be recirculated into the coating liquid supply. However, when a plurality of layers are coated simultaneously the liquid overflows from the edges of the web which is derived from the component layers becomes mixed and thus cannot be recirculated. Usually the liquid used to form coatings on webs is costly and thus it is desirable to use all the liquid present in the curtain and not to waste any of it.

SUMMARY OF THE INVENTION

It is the object of the present invention to provide a curtain coating method wherein the aforesaid difficulties are minimised. According to the present invention there is provided a method of coating a travelling web with at least one layer of a liquid coating composition, comprising the steps of moving the web along a path through a coating zone and forming at the coating zone a free-falling vertical curtain which extends transversely of the path and impinges on the travelling web to deposit thereon a coating, the free-falling curtain being composed of at least two separately formed free-falling partial curtains which are joined edge to edge, one partial curtain constituting an edge region of the integral curtain and the other or others constituting a central region and another edge region of the integral curtain.

Preferably there are provided three partial curtains which constitute the central region and the two edge regions of the integral curtain. The central partial curtain may be wider than the width of the web to be coated, however in an alternative method the central region of the integral curtain may be narrower than the width of the web being coated, but the total width of the curtain should be wider than the web being coated.

It is to be understood that the central region of the integral curtain may comprise several laminae which when they impinge on the travelling web from several layers of coating liquid thereon simultaneously. However preferably only one lamina of liquid is supplied to the edge regions of the curtain.

By use of the method of the present invention it is possible in the edge regions to use cheap liquids which are compatible with the main coating liquid or liquids being used in the central region and thus when they overflow the edge of the web being coated they need not be collected or recirculated. By "compatible" is meant that the liquids are able to join and form a integral curtain across the width of the curtain. For example if a travelling web is being coated with a gelatinous silver halide emulsion or emulsions, a gelatin solution may be used at the two edge regions of the curtain. If required the gelatin solution may be recirculated in the edge regions.

A further very important advantage of the method according to the invention is that it provides a means of maintaining a stable central region of a coating curtain even at extremely low liquid flow rates. It is sometimes necessary to produce very thin coated layers on the web and this requires a very low flow rate. However there is a lower limit of flow rate below which the curtain is unstable at the edge guides forming the boundaries of the curtain. This instability is mentioned in the prior art hereinbefore cited. However in the method of the present invention this instability may be avoided by maintaining a high flow rate per unit width in the edge region while reducing the flow rate per unit width in the central region. When such a method is used the central region of the curtain is made wider than the web so that the higher flow rate in the edge regions does not produce exceptionally thick layers on the edges of the web. In this method the liquid supplied to the edge regions of the curtain may be the same as the liquid supplied to the central-region of the curtain.

However the liquid supplied to the central region may be different from the liquid supplied to the edge regions, or the central region may comprise several laminae of liquid while the edge regions comprises only one liquid. In such circumstance if it be required that the central region of the curtain is slightly wider than the web being coated then it is desirable that the liquid recirculating in the edge regions consists of a mixture of the liquids in the central region in the same proportions as they occur in the total flow of the central region. This ensures that the liquids from the central region, which may overflow the edge of the web and become mixed with the recirculating liquid in the edge region, do not alter the composition of the liquid in the edge region.

The process of the present invention may be achieved by a curtain coating apparatus comprising means for forming a free-falling vertical curtain, such means including at least two separate systems each comprising at least one cavity for containing a coating composition and at least one elongated slot which communicates with the cavity, each system supplying coating composition to a respective lip from whence the coating composition falls to form a separate free-falling partial curtain, the systems and the lips being arranged side by side in such a manner that the several partical curtains join edge to edge to form an integral free-falling curtain.

In one embodiment of such an apparatus the curtain forming means includes three systems which form a first edge region, a central region and a second edge region of the integral free-falling curtain. In another embodiment, the middle of the system comprises at least two separate cavities and at least two slots and is adapted to form a partial curtain which consists of at least two juxtaposed laminae of coating compositions.

BRIEF DESCRIPTION OF THE DRAWINGS

The accompanying drawings will serve to illustrate the methods of the present invention.

DETAILED DESCRIPTION OF THE INVENTION

Figure 1:
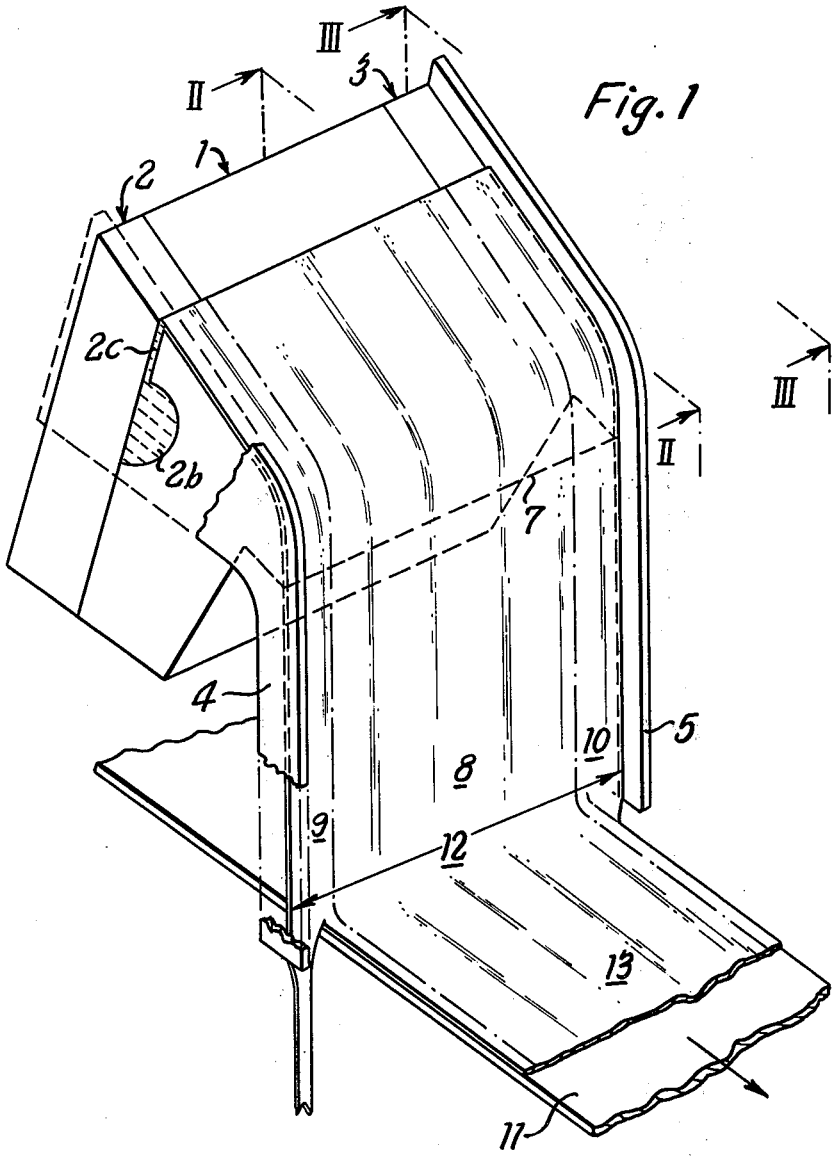
FIG. 1 is a perspective view of a curtain coating apparatus of the slide hopper type according to the process of the present invention showing a free-falling curtain issuing therefrom.

In FIG. 1 an elongated slide liquid coating hopper 1 has on either side thereof subsidiary coating hoppers 2 and 3. Slide hoppers of this type are described in more detail for instance in British patent specifications Nos. 1,276,144 and 1,276,381. Attached to each end of the array of coating hoppers 1, 2 and 3 are two curtain edge guides 4 and 5.

Figure 2:
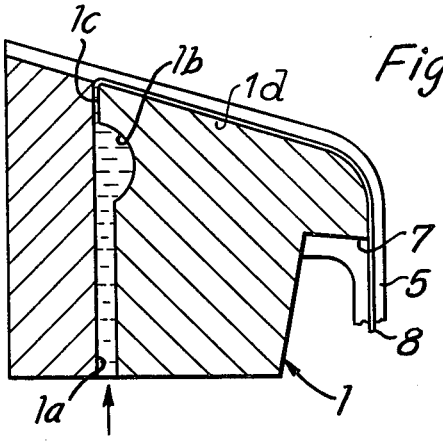
FIGS. 2 and 3 are cross sections of the apparatus of FIG. 1 along the lines II—II and III—III respectively.

FIG. 2 shows in cross-section the enlongated slide liquid coating hopper 1. Liquid is fed into this hopper via a duct 1*a* into the central cavity or chamber 1*b* from which it is forced via the slot or channel 1*c* onto the flat inclined slide surface 1*d* of the hopper. The liquid then slides by gravity down the inclined surface 1*d* until it reaches the lip shaped end 7 of the slide and it then falls as a free-falling curtain 8.

Figure 3:
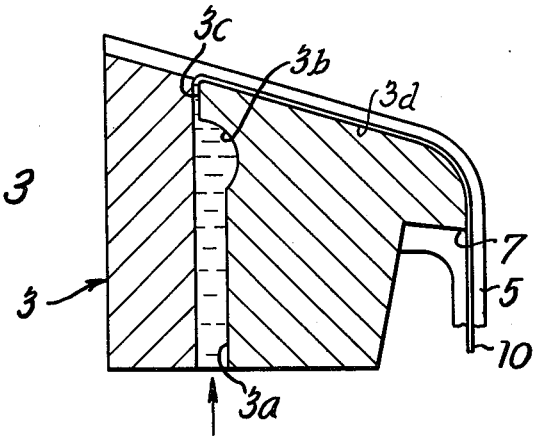

FIG. 3 shows in cross-section the side slide hopper 3. Liquid is fed into this hopper via a duct 3*a* into the central cavity or chamber 3*b* from which it is forced via the slot or channel 3*c* onto the flat inclined slide surface 3*d* of the slide hopper. The liquid then slides by gravity down the inclined surface 3*d* until it reaches the end 7 of the slide and it then falls as a free-falling curtain 10.

Similarly, coating hopper 2 forms a free-falling curtain 9.

Curtains 8, 9 and 10 constitute partial curtains which are joined together edge to edge to form an integral free-falling curtain 12 having two edge regions and a central region.

This integral curtain 12 impinges on to a web 11 which is caused to pass beneath the coating hoppers and forms a coating 13 thereon. The moving means for the web are of common type and therefore not shown.

Usually the width of the central partial curtain is substantially of the same order as that of the web to be coated, whilst the edge curtains are relatively narrow. However the edge curtains should not be narrower than about 5% of the width of the central curtain. In one embodiment the central curtain was 110mm wide and each edge curtain was 15mm wide. The lowest reasonable limit for the width of the edge curtains was found to be 5mm.

In an example a photographic silver halide emulsion was fed into the coating hopper 1 and liquid gelatin solutions into coating hoppers 2 and 3. Excess liquid from the regions 9 and 10 drops off the edge of the travelling web 11.

After the web 11 had been passed through a drying apparatus (not shown) an examination showed that a photographic silver halide emulsion layer was present on the web except along each edge of the web where there was a narrow gelatin layer. It was found that there was virtually no mixing of the gelatin and silver halide and the gelatin layers could be cleanly slit away and discarded when the web was slit into the requisite widths. The thickness of the silver halide emulsion layer was uniform across the web and did not increase or decrease towards the edges of the central region of the curtain.

Figure 4:
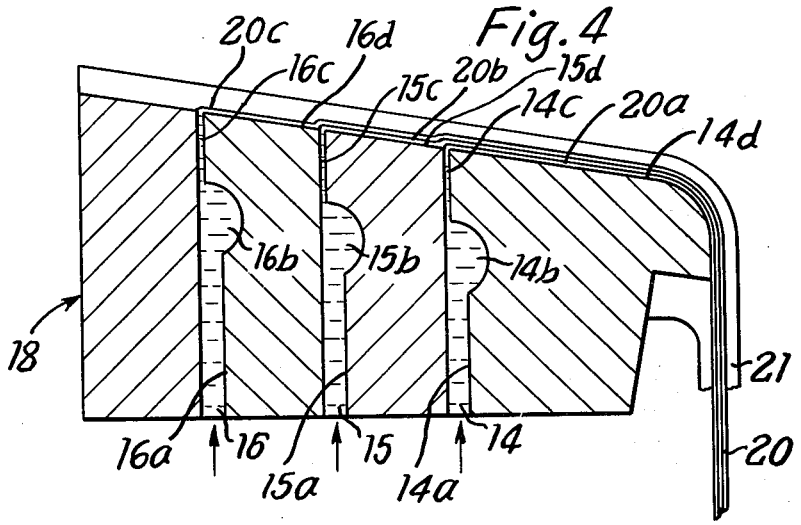
FIG. 4 is a cross section similar to FIG. 2 of the middle portion of a curtain coating apparatus of the slide hopper type wherein a plurality of emulsions issue from slots in the slide surface and form together a multi-layer falling curtain.
Figure 5:
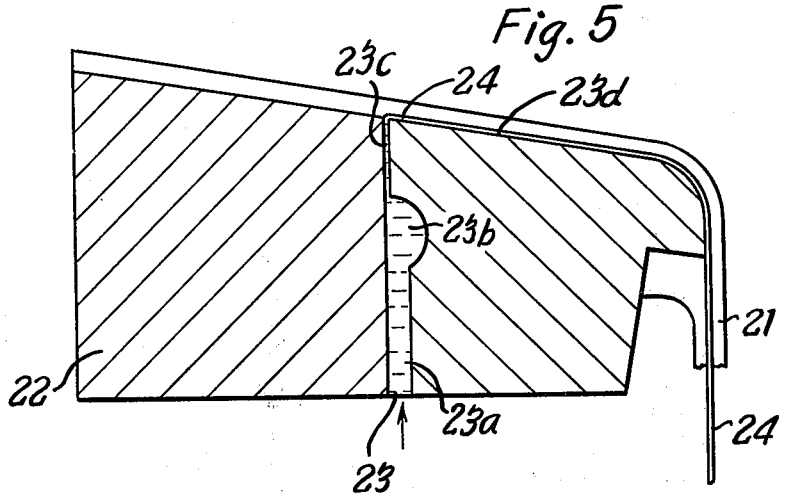
FIG. 5 is a cross-section similar to FIG. 3 of one of the side portions of the slide hopper of FIG. 4 from which only a single-layer falling curtain issues.

In FIGS. 4 and 5 another coating apparatus for use in the process according to the invention is shown in a cross-sectional view similar to FIGS. 2 and 3. The only difference between this apparatus and the apparatus shown in FIGS. 1–3 consists in that the central slide hopper, indicated at 18, is a mutilayer slide hopper. Thus the free-falling partial curtain issuing from this slide hopper 18 comprises a plurality of several laminae of coating liquids.

In FIG. 4 the slide hopper 18 comprises three separate coating systems 14, 15 and 16 from which coating liquid issues. Coating liquid is fed into system 14 through the duct 14*a*, into the central chamber 14*b* and then through the channel 14*c* to emerge on to the flat inclined portion 14*d* of the hopper. Similarly coating liquid is fed into system 15 through the duct 15*a*, into the central chamber 15*b* and then through the channel 15*c* to emerge on to the flat inclined portion 15*d* of the hopper. Similarly coating liquid is fed into system 16 through the duct 16*a*, into the central chamber 16*b* and then through the channel 16*c* to emerge on to the flat inclined portion 16*d* of the hopper.

Liquid 20*c* which emerges from system 16 slides as a layer down portion 16*d* until it reaches the liquid 20*b* emerging from system 15. Then the two liquid layers slide down portion 15*d* until they reach the liquid 20*a* emerging from system 14. Then a three liquid layer is formed which slides down portion 14*d* until it falls off the lip-shaped end of the portion 14*d* as a multi-layered free-falling curtain 20.

The edge guide is shown at 21.

In FIG. 5 one of the two edge slide hoppers is shown. Hopper 22 comprises a single system 23 into which coating liquid is fed via the duct 23*d*, into the central chamber 23*b* and then through the channel 23*c* and onto the flat inclined portion 23*d* of the hopper as a single layer of liquid 24. The layer 24 continues to slide down portion 23*d* until it falls off the hopper as a single liquid curtain. The edge guide is shown at 21.

The complete slide hopper which is arranged across the web (not shown) consists of two hoppers 22 arranged on either side of the central hopper 18 (FIG. 4). The liquid which issues from these hoppers combines across the width of the web to form a integral free-falling curtain of liquid in a manner similar to the integral curtain shown in FIG. 1.

In this case also the liquid used in hoppers 22 is a cheap liquid whilst the liquids used in hopper 18 consist of the liquids which are to be coated on to the web as a multi-layer coating.

The liquid used in hoppers 22 is compatible with the liquids used in hopper 18 so that a complete curtain across the width of the web is formed. The width of the web to be coated is so chosen that the majority of the liquid from the edge hoppers 22 is not coated on the web but only a thin edge portion of the cheap liquid is coated on the web and this can be slit away. The cheap coating liquid which is not coated on the web can be collected and re-circulated. In this case it would be impossible to collect and re-use the liquids in the multi-layer curtain since when collected the three layers would mix.

The slots or channels which connect the chambers or cavities of the several coating systems with their respective slide surfaces may be in alignment as shown in FIG. 1 or may be offset as in the embodiment of FIGS. 4 and 5. The gaps between the slots in two adjacent slide hoppers preferably are as small as possible or zero. The width of these gaps must not be so great as to prevent a complete integral curtain across the width of the apparatus from being formed.

Figure 6:
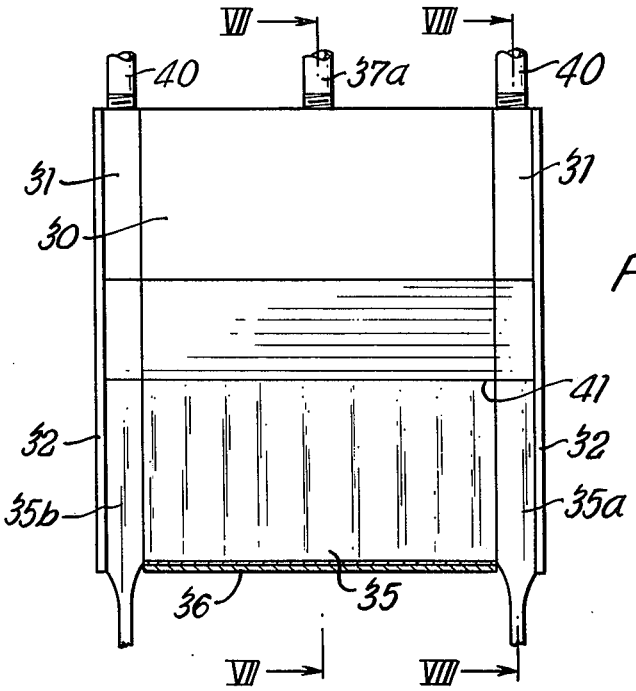
FIG. 6 is another coating apparatus according to the process of the present invention which is of the slot type.
Figure 7:
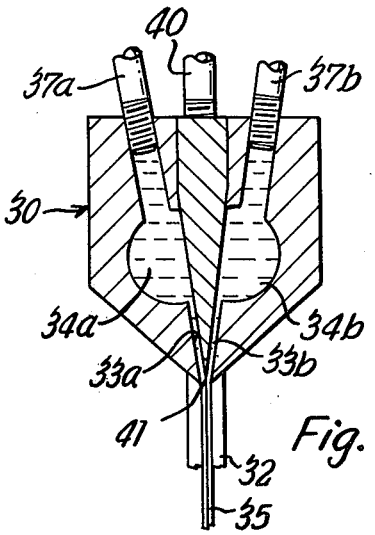
FIGS. 7 and 8 are cross-sections of the apparatus of FIG. 6 along the lines VII-VII and VIII-VIII respectively.
Figure 8:
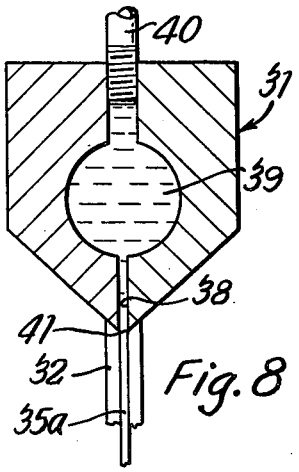

It is to be understood that the three separate coating hoppers of the apparatus of FIGS. 1–3 and FIGS. 4 and 5 could also be combined into a triple hopper having three curtain forming systems. In FIGS. 6–8 there is shown another embodiment of a curtain coating apparatus according to the present invention. The apparatus comprises an elongated slot hopper 30 and two relatively small slot hoppers 31 arranged on either side of the elongated hopper 30. Slot hoppers of the shown type are described for instance in British patent specification No. 1 276 144.

Attached on either side of the apparatus is an edge guide 32. The travelling web 36 is shown only in FIG. 6 beneath the slot hopper 30.

Referring to FIG. 7, this shows in detail the elongated slot hopper 30. It is adapted to form a free-falling curtain 35 which comprises two laminae of coating liquids. One liquid is fed via the duct 37*a* into the central chamber 34*a* from which it passes via the channel 33*a* out of the hopper 30 at the lower tip 41 to form one lamina of the two laminae liquid curtain 35. The other liquid is fed via the duct 37*b* into the central chamber 34*b* from which it passes via the channel 33*b* out of the hopper 30 at the lower tip 41 to form the other lamina of the two laminae liquid curtain 35.

Referring to FIG. 8, this shows in detail one of the small side slot hoppers 31. From these hoppers 31 issue a single-layer free-falling curtains of liquid 35*a* and 35*b*. Liquid is fed via the duct 40 into the central chamber 39 from which it passes via the channel 38 out of the hopper 31 at the lower tip 41 to form one of the p;rtions 35*a* or 35*b* adjacent the liquid curtain 35.

As the liquids emerge from the slot hoppers they join together to form one free-falling liquid curtain having a centralregion of two laminae of liquid which issues from the hopper 30 and edge regions composed of a single lamina of liquid which issue from the two edge hoppers 31. The width of the central region of the free-falling curtain 35 is substantially the same width as the web 36 being coated and thus only liquid from the side hoppers 31 overlows the edge of the web 36. This liquid is compatible with the liquids which are coated as layers on the web 36 but is cheaper and may be disposed of when it overflows the edge of the web 36.

What is claimed is:

1. A method of coating a travelling web with at least two layers of a liquid photographic coating composition, said method comprising:

moving a web to be coated along a path through a coating zone; and forming at said coating zone a free-falling vertical curtain which extends transversely of said path and impinging said curtain on said travelling web to deposit thereon a photographic coating, said step of forming comprising providing said free-falling curtain composed of three separately formed free-falling partial curtains which are integrally joined edge-to-edge to form an integral curtain wider than the width of said web to be coated, a first and a second of said partial curtains constituting edge regions of the integral curtain, and the third partial curtain constituting a central region of said integral curtain, said third partial curtain being narrower than the width of said web to be coated and consisting of at least two juxtaposed laminae of coating liquid, and said first and second partial curtains each being formed to consist of a single lamina of liquid which is different from the liquids forming said third partial curtain, but which with respect to the rheological properties thereof is compatible therewith.

2. The method according to claim 1, wherein the width of each of the partial curtains constituting the edge regions of the integral curtain is at least 5% of the width of the third partial curtain.

3. The method according to claim 1, wherein at least one of the laminae of the third partial curtain consists of an aqueous gelatine silver halide emulsion and the other partial curtains consist of an aqueous gelatine solution.

* * * * *